US005324172A

United States Patent [19]

Manini et al.

[11] Patent Number: 5,324,172

[45] Date of Patent: Jun. 28, 1994

[54] HIGH-CAPACITY GETTER PUMP

[75] Inventors: Paolo Manini; Bruno Ferrario, both of Milan, Italy

[73] Assignee: SAES Getters S.p.A., Milan, Italy

[21] Appl. No.: 59,376

[22] Filed: May 11, 1993

[30] Foreign Application Priority Data

Jul. 17, 1992 [IT] Italy ..... MI92 A 001752

[51] Int. Cl.[5] ..... F04B 37/02

[52] U.S. Cl. ..... 417/51

[58] Field of Search ..... 417/48, 49, 51

[56] References Cited

U.S. PATENT DOCUMENTS 3,203,901 8/1965 Della Porta .
3,284,253 6/1971 Wintzer .
3,310,226 3/1967 Sibley ..... 417/49
3,428,241 2/1969 Eder ..... 417/49
3,609,064 9/1971 Giorgi .
3.662,522 5/1972 Della Porta et al. .
3,780,501 12/1973 Della Porta et al. .
3,926,832 12/1975 Barosi .
3,961,897 6/1976 Giorgi et al. .
4,071,335 1/1978 Barosi .
4,137,012 1/1979 Della Porta et al. .
4,269,624 5/1981 Figini .
4,306,887 12/1981 Barosi et al. .
4,312,669 1/1982 Boffito et al. .
4,907,948 3/1990 Barosi et al. .

*Primary Examiner*—Richard E. Gluck
*Attorney, Agent, or Firm*—David R. Murphy

[57] ABSTRACT

An improved high-capacity getter pump, suitable for creating and maintaining the vacuum, comprising a plurality of porous sintered blades made from a non-evaporable getter material and having a first main surface; a second main surface, parallel to said first surface and spaced therefrom by a thickness of 0.5–5.0 mm; wherein said blades are arranged in a housing and are separated from each other by a gas conductance, with the adjacent surfaces of adjacent blades being spaced from each other by a distance of 0.5–10 mm.

12 Claims, 5 Drawing Sheets

HIGH-CAPACITY GETTER PUMP

BACKGROUND OF THE INVENTION

1. Field of the Invention

The present invention relates to an improved high-capacity getter pump, suitable for creating and maintaining the vacuum, for instance in an ultra-high vacuum chamber or in a high-energy particle accelerator.

2. The Prior Art

Getter pumps are well known in the art and are suitable for creating and maintaining the vacuum. The first commercially successfull getter pump, described in U.S. Pat. No. 3,780,501, was employing, in a housing, a pleated metal strip having a getter metal embedded therein. Additional examples of such getter pumps were described in U.S. Pat. Nos. 3,609,064; 3,662,522; 3,961,897 and 4,137,012. Although these former getter pumps enjoyed a wide commercial success and market acceptance, they were still suffering from a drawback, residing in a limited sorption capacity inside a given volume.

In order to increase said sorption capacity, it was suggested to simply fill the pump housing with a getter material in the form of pellets, having size and shape similar to those (tablets) used in the field of drugs; such pellets were typically showing a cylindrical shape, with a diameter of 5–10 mm and a height of 2–10 mm. However, when the housing is filled with such pellets, the access of the gas to the bulky getter structure is far from being satisfactory. Another drawback, bound to the use of said pellets, was their tendency to produce undesired loose particles; moreover the bulky structure show safety problems because of the possibility of a high exothermicity of the getter material during possible ignitions (in particular when the used getter material has a low activation temperature).

Accordingly, it is a first object of the present invention to provide an improved getter pump substantially free from one or more of the drawbacks hereinabove.

Another object of the invention is to provide an improved getter pump having a higher sorption rate per unit volume, with respect to the getter pumps of the prior art.

A further object of the invention is to provide an improved getter pump having a higher sorption capacity per unit volume, with respect to the getter pumps of the prior art.

An additional object of the invention is to provide an improved getter pump resorting neither to pleated coated strips nor to pellets of getter material.

Other objects of the invention will be apparent to those of ordinary skill in the art, by reference to the following disclosure and drawings.

DISCLOSURE

In its broadest aspect, the invention relates to an improved high-capacity getter pump, suitable for creating and maintaining the vacuum, for instance in a high-energy particle accelerator and in an ultra-high vacuum chamber, said pump comprising a plurality of porous sintered blades made from a non-evaporable getter material having:

i) a first main surface;

ii) a second main surface, essentially parallel to said first surface and spaced therefrom by a thickness of 0.5–5.0 mm;

wherein said blades are arranged in a housing and are separated from each other by a gas conductance (empty intermediate space), with the adjacent surfaces of adjacent blades being spaced from each other by a distance of essentially 0.5–10 mm.

The gas conductances between adjacent blades allow the gas molecules to enter the porous getter structures at a fast rate and the higher porosity of the porous sintered blades better promotes the efficiency of the gas sorption with respect to the pleated strips and to the pellets (or tablets) of the prior art.

Said blades are suitably arranged in a radial way in said housing, defining an inner channel with their inner extremities. The getter pump according to the invention are furthermore equipped with a heater, for heating the blades at the activation temperature and also at the desired operative temperature, and with a flange fastening said housing to a vacuum.

The porous sintered blades of the pump according to the invention may have a shape selected from planar (in particular rectangular and optionally tapered and/or bevelled), concave and combinations thereof. Moreover said blades have a density from 1 to 5 and preferably from 1.5 to 3.5 g/cm and a surface area from 0.05 to 1 $m^2/g$ (preferably 0.1–1 $m^2/g$).

The getter pump according to the present invention may be employed for maintaining the vacuum in a wide range of vacuum devices and apparatuses, for instance closed vacuum vessels (like e.g. a dewar or a vacuum jacket for a fluid transfer piping), particle accelerators (like for instance a synchrotron) and ultra-high vacuum chambers; the new getter pumps can maintain a vacuum Level as high as $10^{-6}$ and even $10^{-12}$ mbar ($10^{-10}$ Pa).

A wide range of non-evaporable getter metals may be employed for the manufacture of the pumps according to the invention, for instance zirconium, titanium, hafnium, tantalum, thorium, uranium, niobium, mixtures thereof and alloys of these metals with each other and with other metals, such alloys being or being not intermetallic compounds. These getter metals may be used alone or in admixture with other materials, like for instance antisintering agents. An exemplifying but not limiting series of non-evaporable getter metals for the manufacture of said porous sintered blades comprises:

a) an alloy containing 84% Zr, balance Al, as described e.g. in U.S. Pat. No. 3,203,901;

b) a metal composition according to U.S. Pat. No. 3,584,253, based on Zr, Ta, Hf, Nb, Ti or U;

c) a metal composition according to example 3 of U.S. Pat. No. 3,926,832, based on a combination of Zr with Zr-Al alloy;

d) the intermetallic compound $Zr_2Ni$ described e.g. in U.S. Pat. No. 4,071,335;

e) the Zr-M1-M2 alloys according to U.S. Pat. No. 4,269,624, where M1 is V or Nb and M2 is Fe or Ni;

f) the Zr-Fe alloys according to U.S. Pat. No. 4,306,887;

g) certain alloys of zirconium, vanadium and iron, as described in U.S. Pat. No. 4,312,669, as well as other alloys of zirconium and vanadium and minor amounts of transition metals such as manganese;

h) certain alloys of zirconium, titanium and iron, as described in U.S. Pat. No. 4,907,948.

PREFERRED EMBODIMENT

According to a preferred embodiment of the present invention, said non-evaporable getter metal is selected from the Zr—V—Fe alloys and the Zr—Ti—Fe alloys, optionally in combination with Zr alone and/or Ti alone, these last being optionally in the form of hydrides. The combinations disclosed in GB patent application 2,077,487, in the name of the Applicant have proved to be particularly advantageous, being obtained from:

I) a ternary particulate Zr—V—Fe non evaporable getter alloy having a composition (by weight) Lying, when plotted on a ternary diagram, within a polygon having as its corners the following points (% b.w.):

a) 75% Zr—20% V—5% Fe b) 45% Zr—20% V—35% Fe c) 45% Zr—50% V—5% Fe

II) a particulate non-evaporable getter metal, selected from Zr and Ti, wherein the Zr and/or Ti particles have a smaller average size than the alloy particles.

Such combinations are traded by the Applicant as "SAES St 172".

One advantageous method for manufacturing the porous sintered blades of the pump according to the invention, starting from the combinations hereinabove, comprises the following steps:

A) said non-evaporable getter metal is prepared in the form of a loose powder of Zr—V—Fe and/or Zr—Ti—Fe alloy particles, optionally in admixture with particles of Zr alone and/or Ti alone and with an expansion agent;

B) said loose powder (or the consequent mixture) is poured in a mould and sintered.

Said alloy particles have preferably a pre-sintering surface area equal to or higher than 0.15 and preferably 0.25 $m^2/g$ and a pre-sintering particle size up to 400 μm, preferably from 1 to 128 μm and even better from 1 to 50 μm.

Said Zr and/or Ti particles, in their turn, have preferably an average particle size from 1 to 55 μm and a surface area from 0.1 to 1.0 $m^2/g$, wherein the weight ratio between the alloy particles and said Zr and/or Ti particles is suitably from 10:1 to 1:1.

A sintering temperature substantially between 700° and 1200° C., maintained for a time comprised between a few minutes and a few hours, is generally considered as a satisfactory one, whereas a lower temperature requires a long time; the sintering time should give rise to a dimensional stability.

The expansion agent may suitably be an inorganic and/or organic base containing nitrogen and/or phosphorus, which completely decomposes below the sintering temperature, for instance urea, azo-di-carbonamide and/or a carbamate like ammonium carbamate, in amounts from 0.1 to 15% b.w., with respect to the non-evaporable getter material (preferably 2–10%). The formula of azo-di-carbonamide is:

$$NH_2—CO—N=N—CO—NH_2$$

The heater may be arranged inside or outside the housing of the getter pump. An electrical current may be allowed to flow directly through the getter material, as described e.g. in U.S. Pat. No. 3,609,064 or heating may be carried out by conduction or by radiation, for instance by means of a UHV quartz lamp.

In this latter case, the porous sintered blades should be slightly tilted with respect to each other (and with respect to the axial plane of the pump), in order to be fully irradiated.

DESCRIPTION OF THE DRAWINGS

The following drawings (FIGS. 1–10) are supplied for illustrative purposes but do not limit in any way the scope of the invention; in particular.

Figure 1:
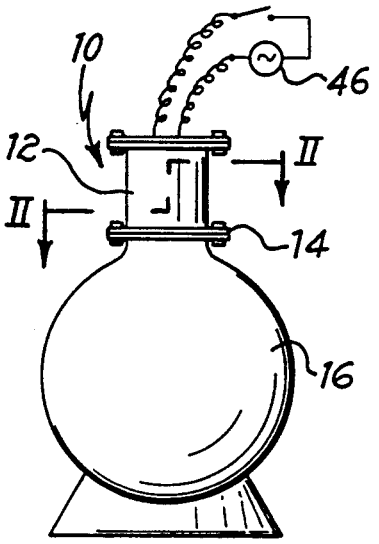
FIG. 1 is a schematic representation of a getter pump according to the present invention in operating conditions.
Figure 3:
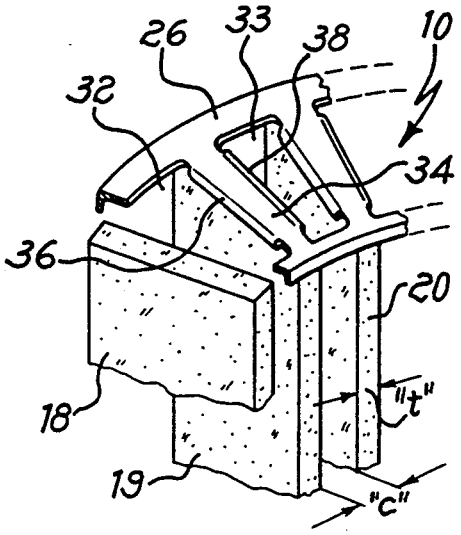
FIG. 3 is a perspective view of a portion of the getter pump as shown in FIG. 2.
Figure 2:
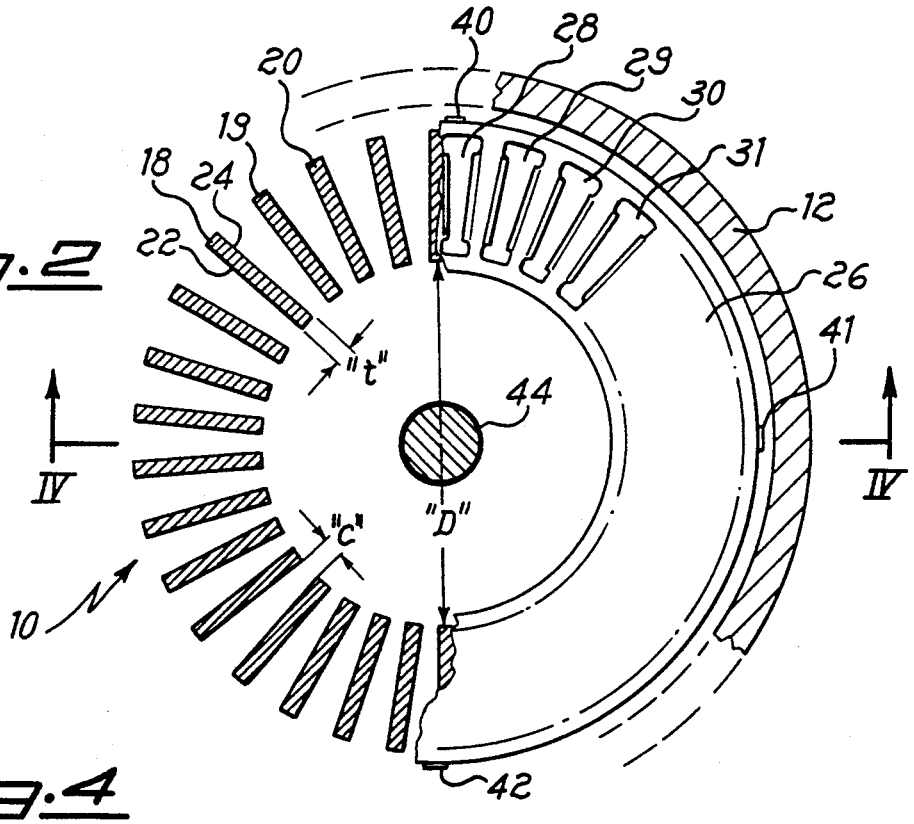
FIG. 2 is an enlarged section view of a getter pump according to the present invention, taken along line II—II of FIG. 1.
Figure 4:
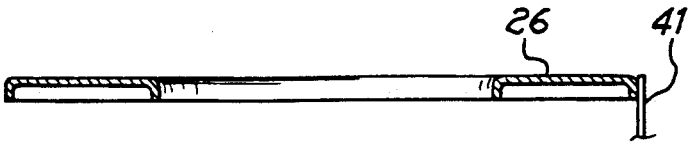
FIG. 4 is a section view of a getter pump according to the present invention, taken along line IV—IV of FIG. 2.

Referring now to the drawings in general and in particular FIGS. 1 and 2, there is shown an improved non-evaporable getter pump 10, having a gas-tight housing 12 provided with a flange 14, which constitutes means for fastening said housing 12 to a vacuum vessel 16.

The getter pump 10 of FIG. 2 has a plurality of porous sintered blades 18, 19, 20, inside a cylindrical housing 12, consisting of a non-evaporable getter metal. Blade 18 has a first planar surface 22 and a second planar surface 24, substantially parallel to said first surface 22, spaced from the first surface by a distance "t" (thickness) of about 0.5–5 mm. Blade 18 can be for instance rectangular in shape. All the blades, like blades 18, 19, 20 and so on, have a similar structure. Blades 18, 19, 20 and so on are radially arranged, with adjacent blades spaced from each other by a distance "c" substantially between 0.5 and 10 mm. The empty space "c" between adjacent blades 18, 19, 20 and so on constitutes a gas conductance.

Figure 5:
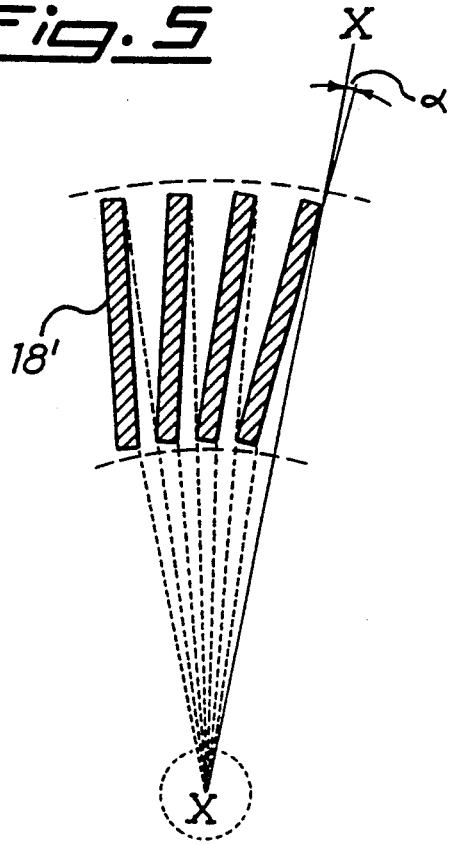
FIG. 5 is a section view of a few blades according to the present invention, forming an angle α with the axial plane X—X of the pump.
Figure 6:
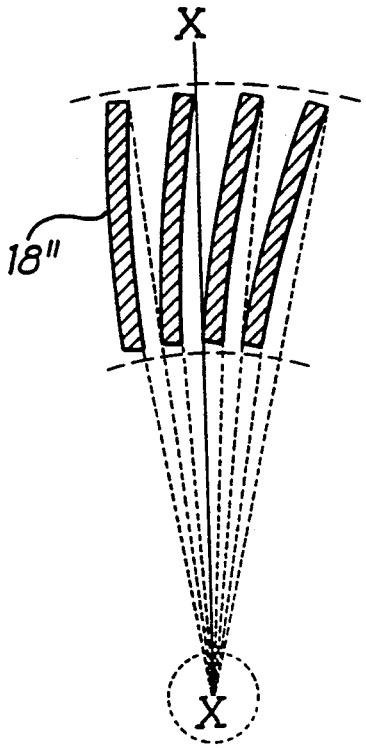
FIG. 6 is a view similar to FIG. 5 showing a different shape of the blades.

The axis of each blade preferably forms with the axial plane X—X of the pump, as shown in FIG. 5, a small angle α, let us say from 1° to 15°, as to protect at least the inner wall of the housing (see blade 18' on FIG. 5) and to consequently reduce the possible degassing from said wall. A proper choice of said α angle also makes it possible the full irradiation of the blades along the radial direction, thus avoiding an inhomogeneous heating of the porous getter material. Overall heating efficiency and power saving are further not-neglectable consequences of such an arrangement. As to the profile of the blade, it may be a straight profile or it can show a small concavity, like blade 18'' on FIG. 6. In both cases of angle α deviation or concavity with respect to the axial direction not only heating of the blades is promoted, but also gas sorption.

The getter pump 10 has a first annular retention plate 26, made from a metal sheet, having a plurality of radially arranged gas passages like passages 28, 29, 30, 31, 32 and 33. Adjacent gas passages (slots) 32, 33 are separated by a rib 34 radially extending from the annular plate 26.

Fins 36, 38 of the radial rib 34 can be axial, parallel to each other and spaced apart from each other by a distance substantially equal to the width of the blade 19; said fins 36, 38 are holding one end of the blade 19. Getter pump 10 also has a second identical annular retention plate (not shown on the drawings) positioned at the bottom (not shown on the drawings) of the blades, like blades 18, 19, 20.

Figure 10:
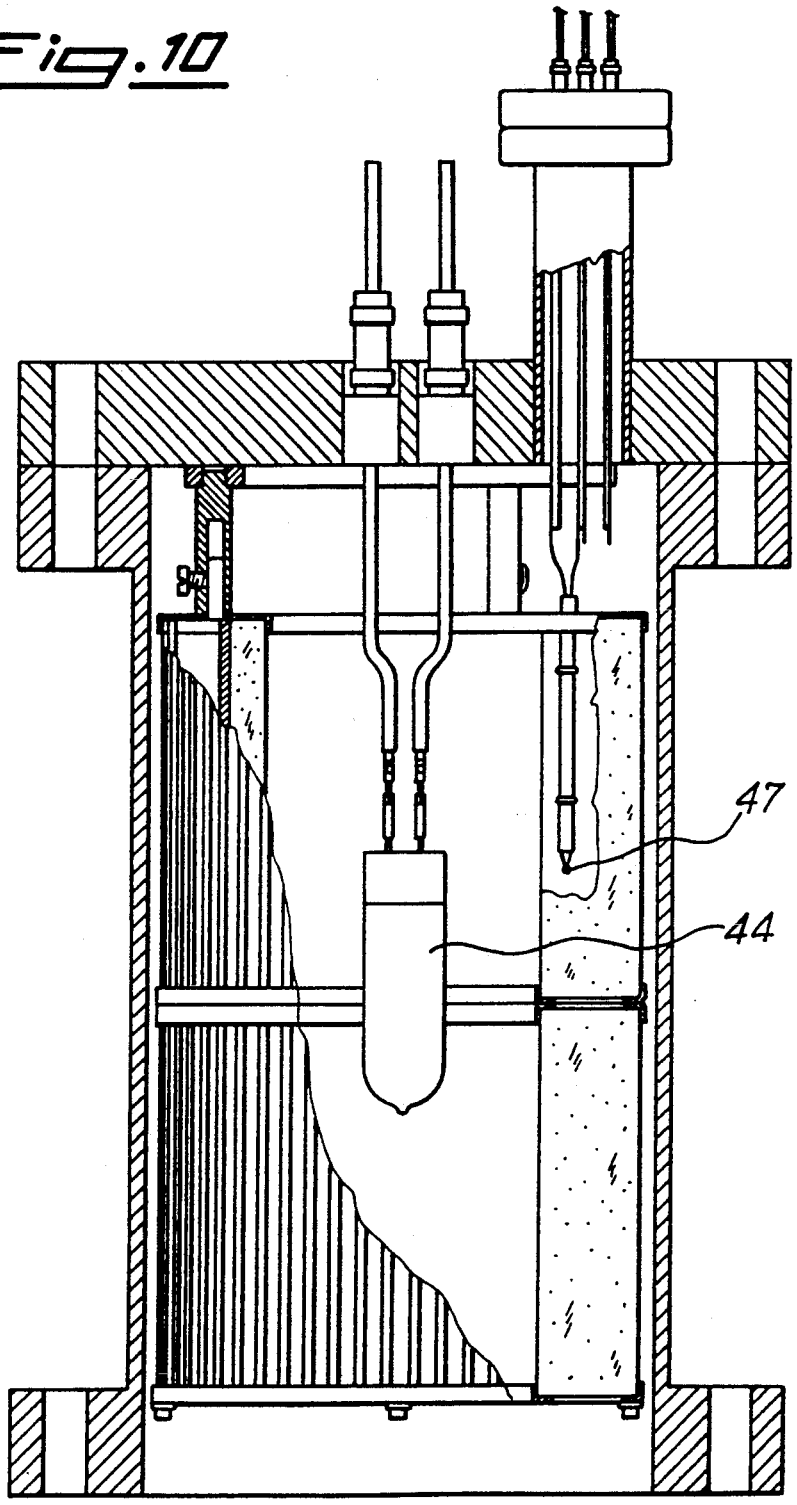
FIG. 10 shows a partially cut-away view of a typical pump according to the invention, where the blades are arranged in different superimposed annular rows (crowns or cartridges).
Figure 11:
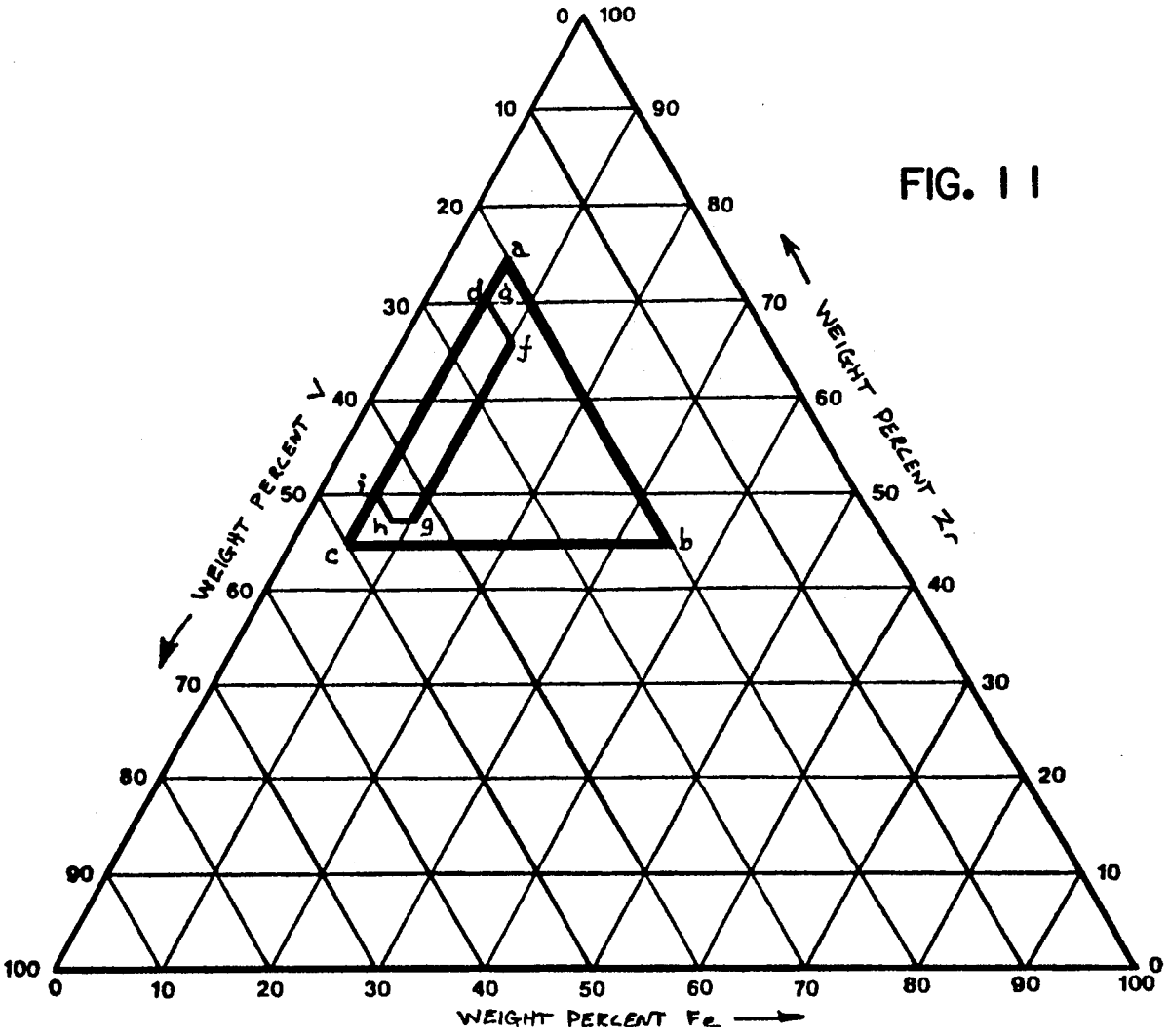
FIG. 11 is a ternary diagram showing a composition of gettering alloys useful in the present invention.

Getter pump 10 has a plurality of straps 40, 41, 42, each of which is spot welded to the periphery of both the first annular retention plate 26 and the second annular retention plate 26 and the second annular retention plate, not shown on the drawings. The same getter pump 10 has a thermocouple 47 and a lamp 44, providing for the heating of the blades at the activation temperature and also at the operative temperature (see FIG. 10). The power required by the lamp 44 is supplied by a power source 46 (FIG. 1). The inner ends of the blades define an inner channel, having diameter D (see FIG. 2) in communication with the gas conductances.

The getter pumps according to the present invention have a sorption capacity several times greater, in a given volume, than the getter pumps of the prior art. Although the invention has been described in considerable detail with reference to certain preferred embodiments, it will be understood that many changes and modifications can be carried out without departing from the scope of the invention; the following examples, in particular are supplied for illustrative purposes but do not limit in any case the scope and the spirit of the invention.

EXAMPLE 1

Part "A" (manufacture of the blades and assembly of the pump)

A porous sintered blade was manufactured starting from a loose powder of a Zr—V—Fe alloy showing the following features:

composition (% b.w.): Zr=70; V=24.5: Fe=5.5;
average particle size =1-128 μm;
surface area =0.25 $m^2/g$.

The alloy powder was then thoroughly admixed, according to a weight ratio 1.5:1 with a Zr loose powder having the following features:

average particle size =1-55 μm;
surface area =0.45 $m^2/g$; and with 5% b.w. of ammonium carbamate ($NH_2$—CO—$NH_4$).

Figure 7:
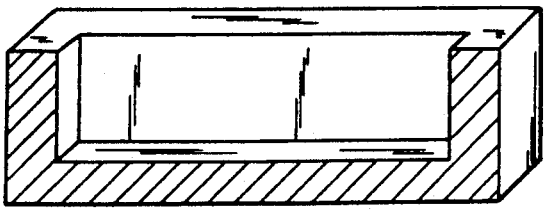
FIG. 7 shows a section view of a mould for sintering planar rectangular blades.

The resulting mixture was loaded into the rectangular graphite mould of FIG. 7, and sintered at 1000° C. for 10 minutes; the resulting blade was 75 mm long, 20 mm wide and 1.4 mm thick. The surface area of the porous sintered blade was 0.14–0.15 $m^2/g$ and the geometrical (visible) surface of the blade was approximately 33 $cm^2$. The density of the blade was 3 $g/cm^3$.

An overall number of 112 blades were prepared in the same way; said blades were radially arranged in two identical superimposed rows (56 blades in each cartridge) and at equal angular distance, in a stainless steel cylindrical housing having an inner diameter of 100 mm, with the external main size of the blades being nearly in contact with the inner wall of the housing (clearance =1 mm). The surface ratio, namely the ratio between the geometrical surface of the blades and the volume of the housing was 3.1 $cm^2/cm^3$ and the diameter of the inner channel, defined by the internal extremities of the radially arranged blades was 58 mm. The volume ratio, namely the ratio between the overall volume of the blades and the empty volume of the housing was 0.21 $cm^3/cm^3$ and the mass ratio was approximately 0.64 $g/cm^3$.

PART "B" (pumping test)

Figure 8:
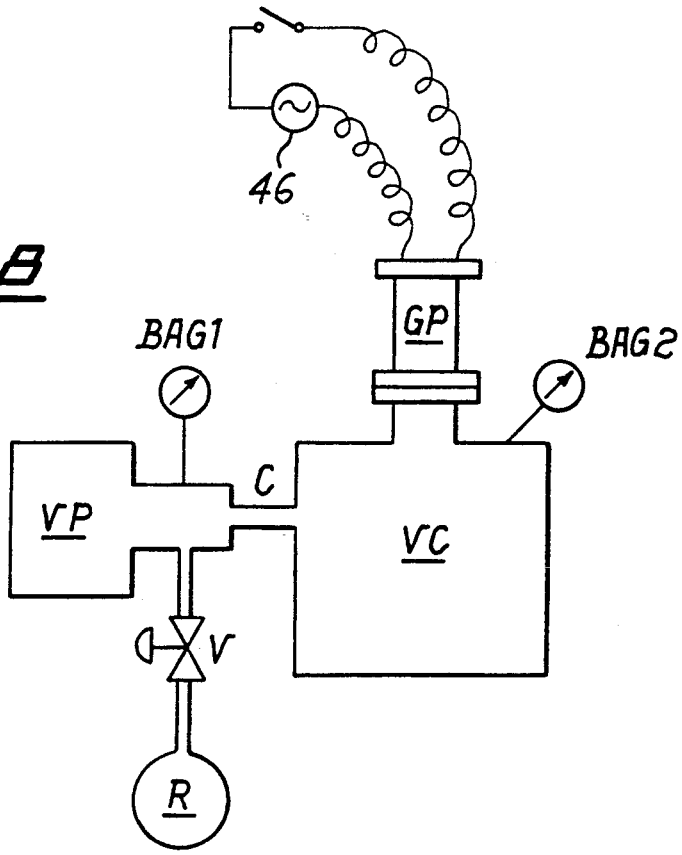
FIG. 8 schematically shows the pumping system employed during the tests of the examples.

As schematically shown in FIG. 8, the getter pump GP was fastened to a vacuum chamber (VC), connected to a high vacuum pumping system (VP) by means of a piping having a known conductance (C) (calibrated conductance). The experimental vacuum chamber was evacuated by the main pumping group down to a pressure in the range of $10^{-8}$ torr.

Heating of the getter pump (activation) was achieved by using an internal quartz lamp, coaxial with the housing of the pump and not shown in the figure.

The quartz lamp was switched on and the getter blades were irradiated until reaching the temperature of 500° C. Such temperature was maintained for 1 hour. The lamp was subsequently switched off and the getter material was brought back to room temperature (25° C.). At this point, a known test gas (CO) coming from a high purity reservoir (R) was allowed to flow through the piping connecting the pumping system and the calibrated conductance. The gas flow was controlled by means of a UHV sapphire valve. Two pressure control gauges (Bayard-Alpert) BAG 1 and BAG 2 were used to continuously measure the pressure values before and after the known conductance (C).

By properly operating the valve (V), the pressure ($P_m$) upstream of the calibrated conductance was kept at a constant level ($1.5\times10^{-4}$ torr), and the pressure ($P_g$) downstream thereof i.e. in the proximity of the getter was monitored for a few hours; said pressure ($P_g$) was lower than the pressure ($P_m$) upstream of the gas conductance, because the getter pump was adsorbing part of the gas entering the volume (VC). The increase of the amount of gas adsorbed by the getter material was corresponding to a reduction of the pumping rate and therefore to an increase of pressure ($P_g$).

From pressure $P_m$ (torr), from gas conductance C (l/s) and from the change of pressure $P_g$ (torr) along the time, it was possible to calculate the pumping rate G (l/s) of the getter pump as a function of the amount of adsorbed gas (torr×l) . As it is known, the amount of gas (Qi) flowing at a certain point through gas conductance (C) is supplied by:

$$Q\,i = C\,(P_m - P_g)\ (\text{torr}\times\text{l/s})$$

Such amount of gas per time unit was coincident with the amount of gas (per time unit) adsorbed by the getter pump, which can be expressed as $G\times P_g$ (torr×l/s) namely as the product of the pumping rate of the getter times the pressure ($P_g$) in the proximity of the same getter. By equalizing the two amounts it is possible to obtain:

$$G\times Pg = C\,(Pm - Pg);$$

wherefrom:

$$G(t)=C[(Pm-Pg(t)]/Pg(t)$$

The overall amount of gas Q adsorbed by the getter pump at the time t can be obtained, as is known, by integrating along the time the amount of gas Qi adsorbed per time unit:

$$Q=\int Qi\,dt=\int G(t)\times Pg(t)\,dt$$

Figure 9:
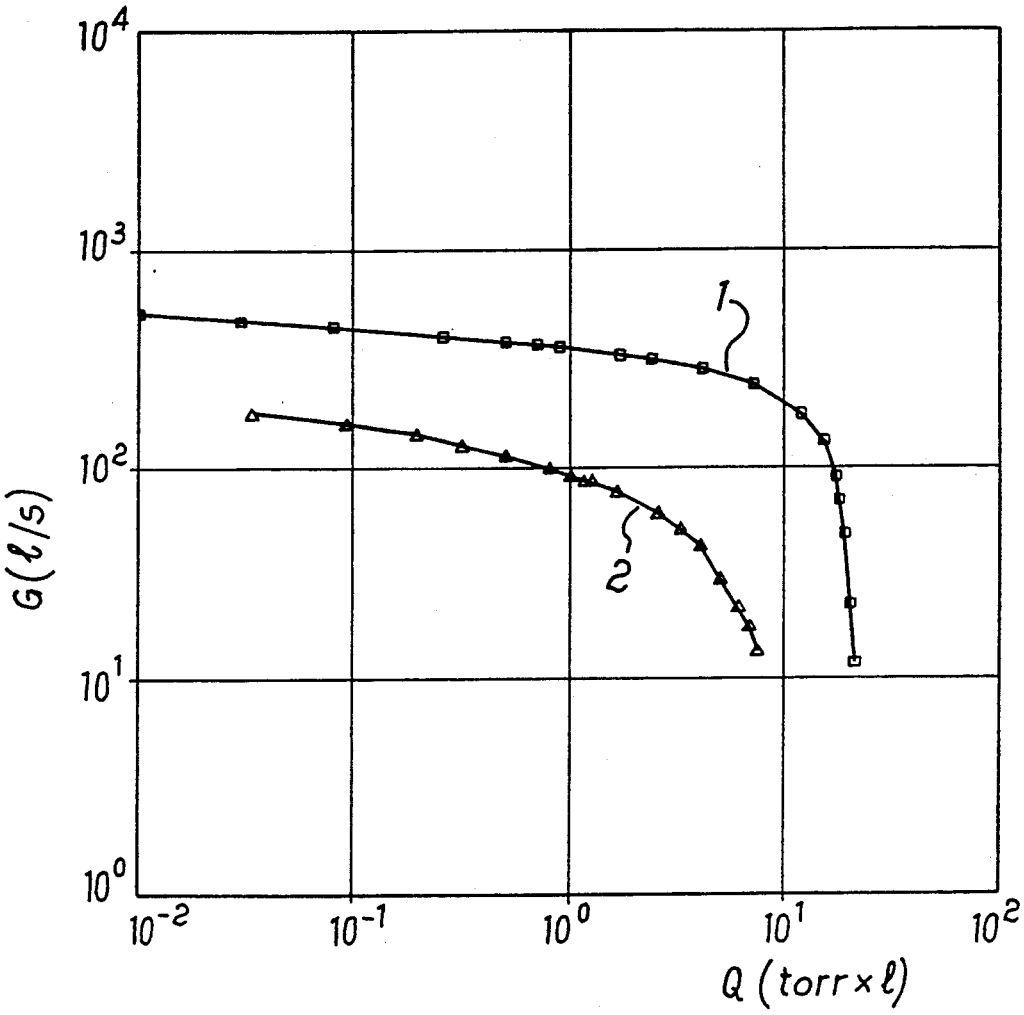
FIG. 9 reports the results of a few pumping tests in the form of a diagram.

The results of this measurement, namely the progress of the pumping rate of the getter as a function of the gas amount adsorbed by the same, are reported in FIG. 9, plotting G (pumping rate) versus Q (sorption capacity), where these data (line 1) are compared with the results (Line 2) obtained using a getter pump according to the prior art (SAES Getters GP 200) described in U.S. Pat. No. 3,662,522 and having an equal housing volume.

From the comparison it is clear that the pumping rate of the improved getter pump GP according to the invention is more than twice the rate of the traditional GP 200 pumps based on coated strips. It is also clear that the sorption capacity, as measured when the pumping rate of the two pumps drops below 100 l/s, is more than one order of magnitude higher with respect to the former pump. The improved getter pump according to the invention therefore provides for significantly higher sorption and capacity features than a traditional NEG (non-evaporable getter) pump for a given housing volume.

EXAMPLE 2

Example 1 was repeated a second time, by replacing carbon monoxide by nitrogen. Also in this case the pumping rate and the sorption capacity were significantly higher with respect to the standard GP 200 pumps.

EXAMPLE 3

Example 1 was repeated a further time by replacing carbon monoxide (CO) by hydrogen ($H_2$). Also in this case the pumping rate of the improved getter pump was more than twice the value of GP 200. Since capacity of hydrogen of the NEG material used for pump manufacturing is much higher than that for CO and $N_2$, the test was stopped after the pump had sorbed 10 torr $\times$l of $H_2$ and much before the point where the pumping rate starts to slow down.

What we claim is:

1. An improved high-capacity getter pump, suitable for creating and maintaining a vacuum, comprising a plurality of porous sintered separate and distinct blades made from a non-evaporable getter material and having:

i) a first main surface;

ii) a second main surface, essentially parallel to said first main surface and spaced therefrom by a thickness of 0.5–5.0 mm;

wherein said separate and distinct blades are arranged in a housing and are separated from each other by a gas conductance in the form of an empty intermediate space, with the adjacent surfaces of adjacent blades being spaced from each other by a distance of essentially 0.5–10 mm.

2. The pump of claim 1, wherein said blades are arranged in a substantially radial way, defining with their inner extremities an inner channel around a longitudinal axis of symmetry of the pump, there being also provided a heater and a fastening flange connected to said housing.

3. The pump of claim 2, wherein said porous sintered blades have axes forming an angle with the axial planes, passing for each blade through said longitudinal axis of the pump, said angle being between 1° and 15°.

4. The pump of claim 1, wherein said porous sintered blades have a density from 1 to 5 g/cm$^3$ and a surface area of from 0.05 to 1 m$^2$/g.

5. The pump of claim 1, wherein said non-evaporable getter material is a metal selected from the group consisting of zirconium, titanium, hafnium, tantalum, thorium, uranium, niobium, mixtures and alloys thereof with other metals.

6. The pump of claim 5, wherein said non-evaporable getter metal is selected from:

a) Zr—V—Fe alloys; and b) Zr—Ti—Fe alloys.

7. The pump of claim 6 wherein said non-evaporable getter metal is selected from the group consisting of:

I) a ternary particulate Zr—V—Fe non-evaporable getter alloy having a composition by weight lying, when plotted on a ternary diagram, within a polygon having as its corners the following points:

a) 75% Zr—20% V—5% Fe b) 45% Zr—20% V—35% Fe c) 45% Zr—50% V—5% Fe; and

II) a particulate non-evaporable getter metal, selected from Zr and Ti, wherein these particles have a smaller average size than the alloy particles.

8. The pump of claim 4, wherein said porous sintered blades have a density from 1.5 to 3.5 g/cm$^3$.

9. The pump of claim 5, wherein said non-evaporable getter material is admixed with an anti-sintering agent.

10. The pump of claim 6, wherein said non-evaporable getter metal is admixed with one or more members selected from the group consisting of: Zr, Ti, Zr hydride, and Ti hydride.

11. A method of claim 8 wherein getter metal, in the form of a loose powder of alloy particles, is in admixture with an expansion agent and is further in admixture with particles of Zr and/or Ti.

12. A method of claim 11 wherein the Zr and/or Ti particles having an average particle size of 1 to 55 microns, and a surface area from 0.1 to 1.0 m$^2$/g; and wherein the weight ratio between the alloy particles and said Zr and/or Ti particles is from 10:1 to 1:1.

* * * * *